US007585096B2

(12) United States Patent
Fallahi et al.

(10) Patent No.: US 7,585,096 B2
(45) Date of Patent: Sep. 8, 2009

(54) COMPOUND TROUGH REFLECTOR FOR LED LIGHT SOURCES

(75) Inventors: Amir P. Fallahi, W. Bloomfield, MI (US); Jeffrey Allen Erion, Plymouth, MI (US); Jeyachandrabose Chinniah, Canton, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 448 days.

(21) Appl. No.: 11/131,824

(22) Filed: May 18, 2005

(65) Prior Publication Data

US 2006/0262551 A1 Nov. 23, 2006

(51) Int. Cl.
*F21V 7/00* (2006.01)

(52) U.S. Cl. ..... 362/517; 362/545; 362/297

(58) Field of Classification Search ..... 362/518, 362/516, 517, 297, 545, 341, 346, 507, 800
See application file for complete search history.

(56) References Cited

U.S. PATENT DOCUMENTS 3,679,893 A * 7/1972 Shemitz et al. ..... 362/345
4,351,018 A 9/1982 Fratty
4,570,203 A 2/1986 Daniels et al.
4,704,661 A * 11/1987 Kosmatka ..... 362/518
4,755,916 A 7/1988 Collins
4,905,133 A 2/1990 Mayer et al.
4,916,585 A * 4/1990 Nino ..... 362/518
4,954,938 A * 9/1990 Lyons ..... 362/298
5,515,255 A * 5/1996 Nielson et al. ..... 362/297
5,544,021 A 8/1996 Lopez et al.
5,568,680 A 10/1996 Parker
5,607,229 A 3/1997 Rykowski et al.
5,951,157 A 9/1999 Shirai et al.
6,068,391 A 5/2000 Saladin et al.
RE36,790 E 7/2000 Jincks et al.
6,155,694 A 12/2000 Lyons et al.
6,206,554 B1 3/2001 Schuster et al.
6,257,737 B1 7/2001 Marshall et al.
6,338,568 B1 1/2002 Futami
6,341,886 B1 1/2002 Dussans et al.
6,371,635 B2 4/2002 Ott et al.
6,376,996 B1 4/2002 Olson
6,461,008 B1 * 10/2002 Pederson ..... 362/35

(Continued)

OTHER PUBLICATIONS

LED Headlamps (SAE International Paper Series 2004-01-0437) Mar. 8-11, 2004) by Kiyoshi Sazuka.

*Primary Examiner*—Laura Tso
*Assistant Examiner*—Gunyoung T Lee
(74) *Attorney, Agent, or Firm*—Brinks Hofer Gilson & Lione

(57) ABSTRACT

A light assembly and reflector are provided for redirecting light from a light source in a motor vehicle. The reflector generally includes a first parabolic trough, a second parabolic trough, and third trough. The first and second parabolic troughs define first and second trough axes. The third trough has a third trough axis. The first and second parabolic troughs are positioned on opposing sides of the third trough, and the first and second trough axes are angled relative to the third trough axis. In this manner, the reflector collects and reflects a sufficient amount of light while providing control over the beam pattern spread, particularly in the horizontal direction, whereby a single LED may be employed such that constraints imposed by heat dissipation are significantly reduced.

18 Claims, 3 Drawing Sheets

U.S. PATENT DOCUMENTS 6,471,383 B1 * 10/2002 Oyama et al. ..... 362/517
6,474,845 B1 11/2002 Mabe et al.
6,585,399 B2 7/2003 Kreutzer et al.
6,603,243 B2 8/2003 Parkyn et al.
6,609,816 B2 8/2003 Ansari et al.
6,626,565 B2 9/2003 Ishida
6,726,346 B2 4/2004 Shoji
6,742,919 B2 6/2004 Tiesler-Wittig
6,824,284 B2 11/2004 Chinniah et al.
6,851,835 B2 2/2005 Smith et al.
6,953,261 B1 * 10/2005 Jiao et al. ..... 362/217
2003/0174515 A1 9/2003 Huang
2004/0202005 A1 10/2004 Moisel
2004/0208018 A1 10/2004 Sayers et al.
2004/0240223 A1 * 12/2004 Brun et al. ..... 362/517

* cited by examiner

COMPOUND TROUGH REFLECTOR FOR LED LIGHT SOURCES

FIELD OF THE INVENTION

The present invention relates generally to reflectors for light sources used in automotive applications, and more particularly relates to trough reflectors for LED light sources.

BACKGROUND OF THE INVENTION

Modern automotive light modules typically use a filament bulb as their light source. While such modules have a long and successful history, filament bulbs consume a large amount of power and have a relatively short life. In an attempt to overcome these shortcomings, others have proposed to utilize LED light sources to replace the filament bulbs since LED's consume significantly less power and have a long life span.

Unfortunately, LED solutions also have their drawbacks. In particular, automotive light assemblies utilizing LED light sources typically use a large number LED's, typically eight or more, which thus requires increasing amounts of power over a single LED bulb. Furthermore, these light modules using LED light sources suffer from poor efficiency, that is, the amount of original light from the light source which is actually directed outwardly away from the vehicle to illuminate the surrounding area.

In some applications, trough reflectors have been used for LED light sources. However, these reflectors usually result in a wider horizontal spread of the light beam than is required or desired. While side walls have been proposed to cut down on the horizontal spread, such reflectors overly constrain the light distribution. Furthermore, the use of side walls results in wasted light which is beyond the driver's field of vision. Additionally, the light collection efficiency of the trough reflector depends on its width, and the wider the trough the more horizontal the spread. Likewise, to collect a sufficient amount of light for a given width of the trough, numerous LED's must be placed at regular intervals along the trough axis. The use of multiple LED's increases the horizontal spread even further and also increases the amount of power consumed and the heat which must be dissipated.

Accordingly, there exists a need to provide a light assembly and trough reflector for a motor vehicle which can collect a sufficient amount of light, preferably from a single LED, while at the same time providing control over the horizontal spread as well as other beam pattern characteristics.

BRIEF SUMMARY OF THE INVENTION

One embodiment of the present invention provides a reflector for redirecting light from a light source in a motor vehicle along a longitudinal axis. The reflector generally includes a first parabolic trough, a second parabolic trough, and third trough. The first and second parabolic troughs define first and second trough axes. The third trough has a third trough axis. The first and second parabolic troughs are positioned on opposing sides of the third trough. The first and second trough axes are angled relative to the third trough axis. In this manner, a reflector is provided which collects and reflects a sufficient amount of light while providing control over the beam pattern spread, particularly in the horizontal direction, whereby a single LED may be employed such that constraints imposed by heat dissipation are eliminated.

According to more detailed aspects, the first and second trough axes are angled in the range of 5 degrees to 45 degrees relative to the third trough axis. The third trough axis is generally perpendicular to the longitudinal axis. The third trough may be parabolic trough, or alternately may follow a complex curvature. Forming the third trough with a complex curvature permits increased control over the beam spread pattern and the creation of "hot spots". The third trough may include a plurality of facets and most preferably includes two side facets connected to opposite sides of a center facet. In this case, the two sided facets are angled relative to the center facet, and each of the facets extend from an upper edge to the lower edge of the third trough.

Another embodiment of the present invention provides a light assembly for a motor vehicle which generally comprises a single LED light source and an embodiment of the reflector described above.

BRIEF DESCRIPTION OF THE DRAWINGS

The accompanying drawings incorporated in and forming a part of the specification illustrate several aspects of the present invention, and together with the description serve to explain the principles of the invention. In the drawings.

DETAILED DESCRIPTION OF THE INVENTION

Figure 1:
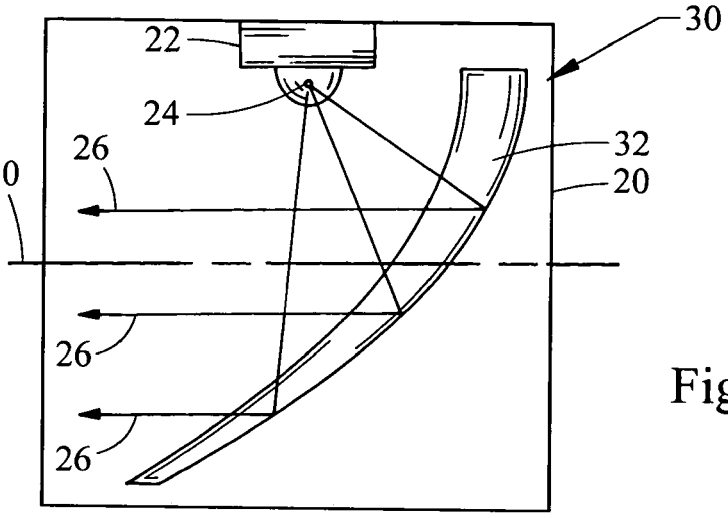
FIG. 1 depicts a schematic side view of an automotive light assembly having a reflector constructed in accordance with the teachings of the present invention.

Turning now to the figures, FIGS. 1-4 depict a light assembly 20 having a single LED light source 22 producing light (depicted as lined arrows 26) from a source point 24. The light assembly 20 further includes a reflector 30 positioned adjacent the LED bulb 22 which redirects the light 26 outwardly along a longitudinal axis 10 of assembly 20, which correspond with the longitudinal axis of the motor vehicle. Specifically, the reflector 30 is structured to collect the light 26 and collimate the light vertically by reflecting the light outwardly along the axis 10.

Figure 2:
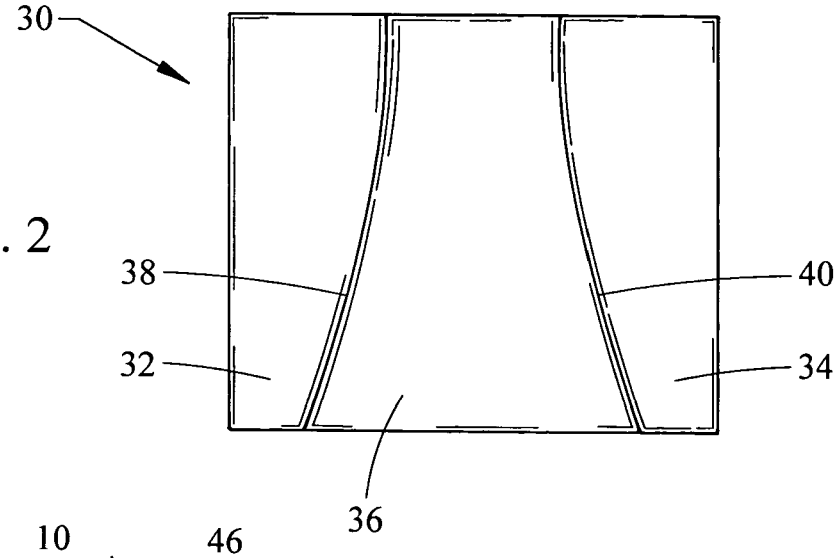
FIG. 2 is a front view of the reflector depicted in FIG. 1.
Figure 3:
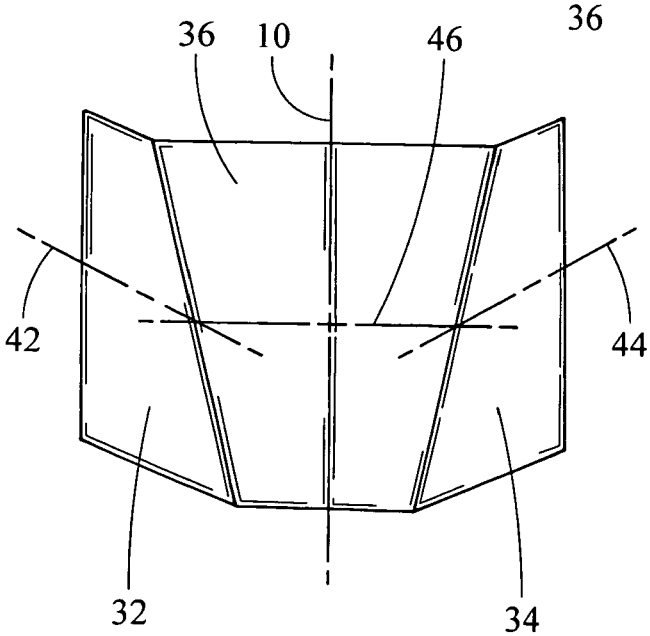
FIG. 3 is a top view of the reflector depicted in FIGS. 1 and 2.
Figure 4:
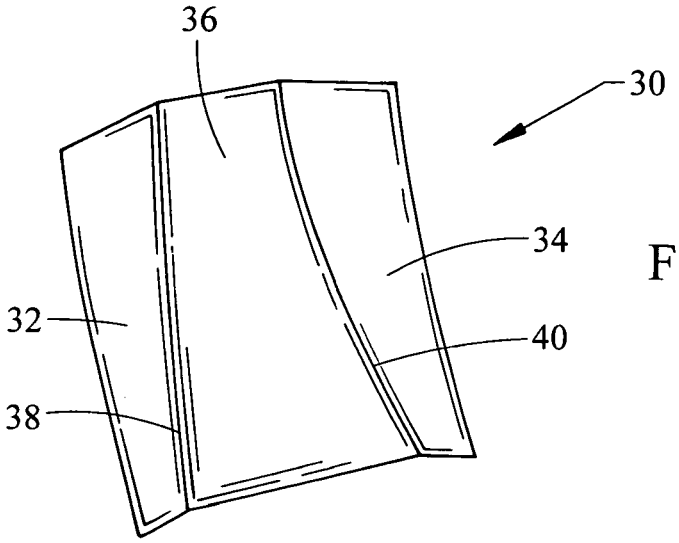
FIG. 4 is a perspective view of the reflector depicted in FIGS. 1-3.

As best seen in FIGS. 2-4, the reflector 30 generally comprises a first trough 32, a second trough 34 and a third trough 36. The first and second troughs 32, 34 are positioned on opposing sides of the third trough 36, and hence the reflector 30 is a compound trough. In this embodiment, all of the troughs 32, 34, 36 are constructed as parabolic troughs having a curvature which follows a parabola, as best seen in FIG. 1. This parabolic curvature results in the vertical collimation of light as previously noted.

In order to control the beam pattern spread and to prevent excess horizontal spread, the first and second parabolic troughs 32, 34 are angled relative to the third trough 36. As best seen in FIG. 3, the first, second and third troughs 32, 34, 36 each include a trough axis, namely first, second and third trough axes 42, 44, 46. The central trough axis 46 is generally perpendicular to the longitudinal axis 10. As used herein, the term "generally" refers to a slight variation from absolute perpendicularity by less than about 3 degrees.

It can therefore be seen that the first and second trough axes 42, 44 are rotated relative to the third trough axis 36. In the present embodiment, the first and second troughs have been rotated about 23 degrees relative to the third trough 36, but the angle of rotation is preferably in the range of 5 degrees to 45 degrees depending on the beam spread requirements. Likewise, angles of rotation for the first and second troughs 32, 34 outside of this range may be utilized for other lighting applications which require such beam spread characteristics. Preferably, the first trough 32 and second trough 34 are rotated identical amounts and thus represent mirror images of each other relative to the longitudinal axis 10, although it will be recognized that varying angles of rotation may be used depending on the particular application and beam spread requirements. Generally, the troughs 32, 34, 36 are connected along seams 38, 40. The first and second troughs 32, 34 may be connected to the third trough 36 by any conventional means, such as by integrally and unitarily molding the reflector 30, welding, adhesives, mechanical attachment means such as fasteners, threaded fasteners, rivets, etc., and plastic welding techniques.

The focal lengths of the first, second and third parabolic troughs 32, 34, 36 may also be varied. For example, the first and second parabolic troughs 32, 34 have been depicted as having a focal length of about 12 mm, while the third parabolic trough 36 has a focal length of about 10 mm. The compound trough forming the reflector 30 is structured to have an overall width of about 40 mm and the height is limited to about 35 mm, although it will be recognized by those skilled in the art that numerous variations and the size may be employed depending on the particular application and beam spread requirements. As used herein, the focal length refers to the shortest distance between the focal point of the parabola and a surface of the particular reflector trough 32, 34, 36. With reference to FIG. 1, the LED light source 22 preferably has a source point 24 that is located at the focal point of the third trough 36 and aligned with the longitudinal axis 10 (i.e. centered horizontally in the reflector 30). Since the LED light source 22 is centered within the reflector 30, the distance between the LED bulb 22 to the first and second troughs 32, 34 on the sides of the reflector 30 is somewhat greater than the distance to the third trough 36.

The structure of the trough 30 depicted in FIGS. 1-4 results in a light collection efficiency of 60 to 70 percent, with 85 percent reflectivity. Furthermore, the horizontal spread is limited to +/−25 to 40 degrees, depending upon the orientation of the side troughs, i.e., the angling of the first and second troughs 32, 34. It can therefore be seen that the trough 30 provides a vast improvement over a traditional parabolic trough which typically exhibits a horizontal spread of +/−70 degrees. Also, unlike the multiple-LED trough with side walls, the compound trough 30 never wastes light in the foregoing area below or outside the driver's field of vision. Accordingly, the light assembly 20 and its reflector 30 may be used with a single LED light source 22, eliminating the thermal constraints imposed by using a series or row of LED light sources.

Figure 5:
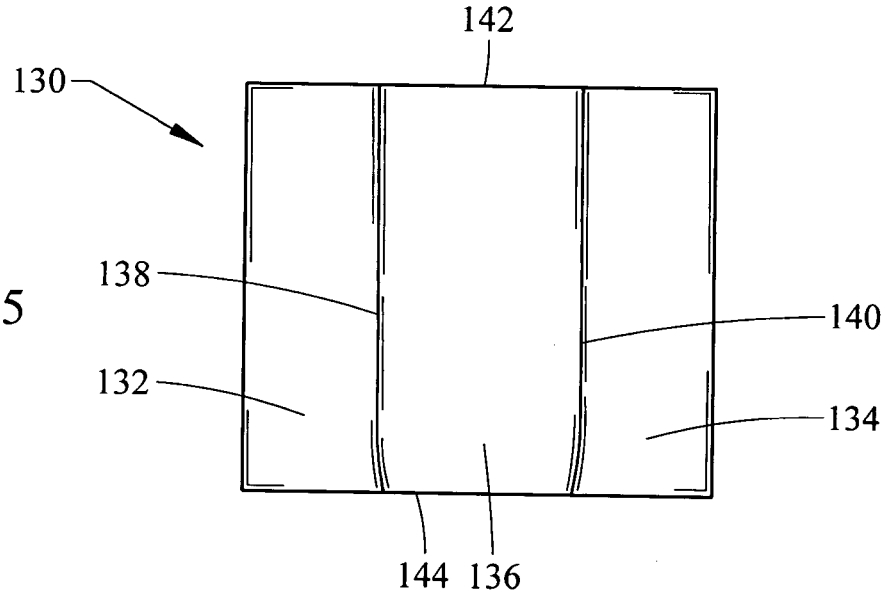
FIG. 5 is a front view of an alternate embodiment of reflector depicted in FIGS. 1-4.
Figure 6:
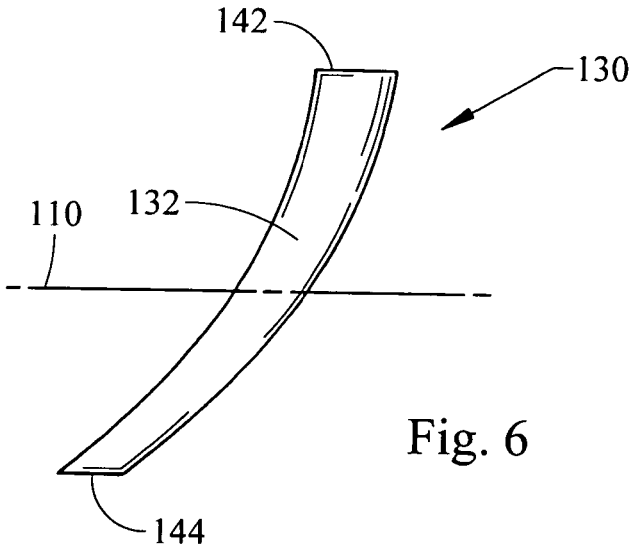
FIG. 6 is a side view of the reflector depicted in FIG. 5.

An alternate embodiment of the reflector constructed in accordance with the teachings of the present invention has been depicted in FIGS. 5 and 6. In this embodiment, the reflector 130 also includes first and second troughs 132, 134 connected to opposing sides of a third trough 136. The troughs 132, 134 are connected to the third trough 136 at seams 138, 140 which may be formed in any of the manners previously described for the embodiment depicted in FIGS. 1-4. However, in this embodiment the third trough 136 is formed to follow a complex curvature, rather than a parabolic curve as in the prior embodiment. This curvature can be seen in FIG. 6, depicting a side view of the reflector 130. It can also be seen that the seams 138, 140 are generally vertically oriented as opposed to the curved seams 38, 40 of the prior embodiment.

By forming the third and central trough 136 to follow a complex curvature (i.e. a numerically generated curve), a particular vertical collimation of the light may be generated. For example, the central trough 136 may not perfectly collimate the light and in fact may result in some beam spread or focus in the vertical direction. In this manner, the reflector 130 may be used to form a "hot spot", which is known in the art and is preferable for certain lighting applications such as head lamps. By using parabolic troughs for the first and second troughs 132, 134 the same benefits are achieved as in the prior embodiment, such as limiting the horizontal spread and preventing redirection of light in the foreground area below the driver's field of vision, while at the same time providing control over the beam spread characteristics.

Figure 7:
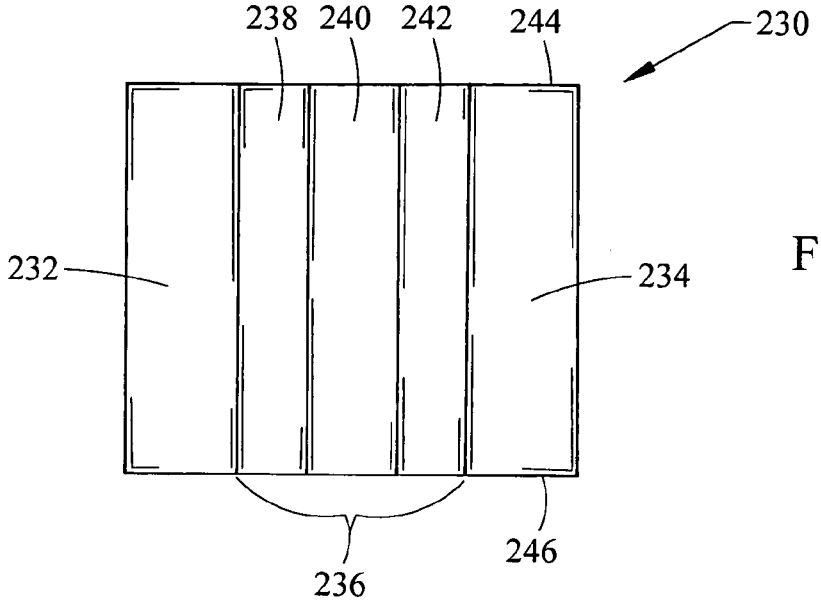
FIG. 7 is a front view of yet another embodiment of the reflector depicted in FIGS. 1-4.
Figure 8:
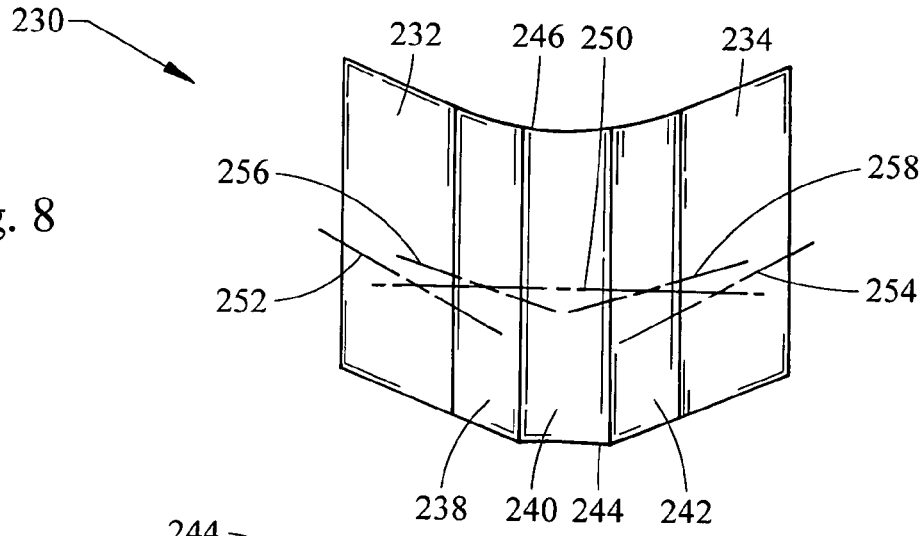
FIG. 8 is a top view of the reflector depicted in FIG. 7.
Figure 9:
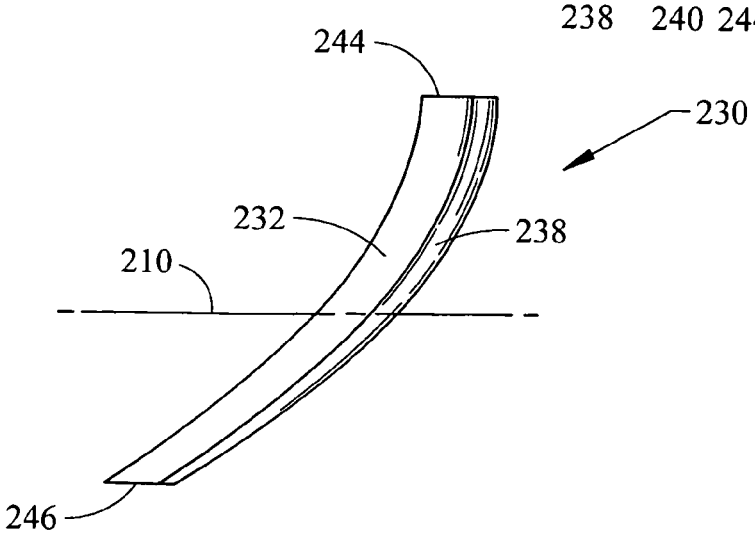
FIG. 9 is a side view of the reflector depicted in FIGS. 7 and 8.

Yet another embodiment of a reflector 230 constructed in accordance with the teachings of the present invention has been depicted in FIGS. 7-9. As with the prior embodiments, the reflector 230 generally includes a compound trough having first trough 232, a second trough 234, and a third trough 236 oriented relative to a longitudinal axis 210. However, in this embodiment the third and central trough 236 has been constructed of a plurality of facets 238, 240, 242. Each of the facets 238, 240, 242 extend from an upper edge 244 to a lower edge 246 of the reflector 230. While the facets 238, 240, 242 have been shown as vertically extending, it will be recognized by those skilled in the art that the facets may also extend horizontally (i.e. vertically stacked), thereby permitting further variation in the resulting beam spread characteristics while still achieving the benefits of the present invention.

As with the embodiment depicted in FIGS. 5-6, each of the facets 238, 240, 242 follow a complex curvature, which is best seen in the side view of FIG. 9. As best seen in FIG. 8, the side facets 238, 242 are rotated relative to the center facet 240. Particularly, the side facets 238, 242 include facets axes 256, 258 which are rotated relative to the facet axis 250 of the central facet 240. Preferably these facets are rotated in the range of 1 to 20 degrees. As with the prior embodiments, the first and second parabolic troughs 232, 234 are also rotated relative to the center trough 236, and particularly the center facet 240, preferably in the range of 5 to 45 degrees as in the prior embodiments. Specifically, the first and second trough axes 252, 254 of the first and second troughs 232, 234 are rotated relative to the central facet axis 250 within the prescribed range, or outside of that range if needed for a particular lighting application. As with the prior embodiments, the trough axis 250 of the central trough 236 and particularly the central facet 240 is generally perpendicular to the longitudinal axis 210.

By using a complex curvature for the facets 238, 240, 242 and at the same time providing for variation in the rotation angle of the side facets 238, 240, excellent control over the beam spread characteristics is provided. As with the prior embodiments, utilizing parabolic troughs 232, 234 on opposing sides of the central trough 236 results in improved light collection, efficiency and reflectivity, while also providing better limitation of the horizontal spread and preventing the waste of light in the foreground area out of the driver's field of vision.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

The invention claimed is:

1. A reflector for redirecting light from a light source in a motor vehicle, the reflector defining mutually perpendicular longitudinal, lateral, and vertical axes, light being directed in a longitudinal direction, the reflector comprising:

a first parabolic trough having a first trough axis;

a second parabolic trough having a second trough axis; and a third trough having a third trough axis, the first and second parabolic troughs positioned on opposing sides of the third trough, the first and second trough axes being angled relative to the third trough axis;

the first, second, and third trough axes extending linearly in a side direction; a point light source positioned transverse to the longitudinal axis.

2. The reflector of claim 1, wherein the first and second trough axes are angled in the range of 5 degrees to 45 degrees relative to the third trough axis.

3. The reflector of claim 1, wherein the third trough axis is generally perpendicular to the longitudinal axis.

4. The reflector of claim 1, wherein the third trough is a parabolic trough.

5. The reflector of claim 1, wherein the third trough follows a complex curvature.

6. The reflector of claim 1, wherein the third trough includes a plurality of facets.

7. The reflector of claim 6, wherein the plurality of facets includes two side facets connected to opposite sides of a center facet, and wherein the two side facets are angled relative to the center facet.

8. The reflector of claim 6, wherein each of the plurality of facets extends from an upper edge to a lower edge of the third trough.

9. The reflector of claim 1, wherein the first and second troughs mirror each other about the longitudinal axis.

10. The reflector of claim 1, wherein the third trough has a focal length that differs from the focal length of the first and second troughs.

11. The reflector of claim 10, wherein the first and second troughs each have a focal length greater than the focal length of the third trough.

12. The reflector of claim 1, wherein the first and second trough axes are angled relative to the lateral axis.

13. A reflector for redirecting light from a light source in a motor vehicle, the reflector defining mutually perpendicular longitudinal, lateral, and vertical axes, light being directed in a longitudinal direction, the reflector comprising:

a first parabolic trough having a first trough axis;

a second parabolic trough having a second trough axis; and a third trough having a third trough axis, the first and second parabolic troughs positioned on opposing sides of the third trough, the first and second trough axes being angled relative to the third trough axis;

the first, second, and third trough axes extending linearly in a side direction;

a light emitting diode (LED) light source emitting light vertically toward the first, second and third troughs.

14. The reflector of claim 13, wherein the first and second trough axes are angled in the range of 5 degrees to 45 degrees relative to the third trough axis.

15. The reflector of claim 13, wherein the third trough is a parabolic trough.

16. The reflector of claim 13, wherein the third trough is follows a complex curvature.

17. The reflector of claim 13, wherein the third trough includes a plurality of facets, each facet extending in the vertical direction from an upper edge to a lower edge of the third trough.

18. The reflector of claim 17, wherein the first, second and third troughs vertically collimate light from the light source.

* * * * *